US008776281B2

(12) United States Patent
Dondurur et al.

(10) Patent No.: US 8,776,281 B2
(45) Date of Patent: Jul. 15, 2014

(54) SYSTEM FOR UNCLOGGING TOILETS

(75) Inventors: Mehmet Dondurur, Truro Lane, MD (US); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 344 days.

(21) Appl. No.: 13/311,463

(22) Filed: Dec. 5, 2011

(65) Prior Publication Data

US 2013/0139308 A1 Jun. 6, 2013

(51) Int. Cl.
*E03D 9/00* (2006.01)

(52) U.S. Cl.
USPC ..... 4/255.04; 4/255.01

(58) Field of Classification Search
CPC ..... E03C 1/302; E03C 1/304; E03C 1/306; E03C 1/308; E03F 9/002; E03D 9/00
USPC ..... 4/255.01–255.09, 255.11, 255.12
See application file for complete search history.

(56) References Cited

U.S. PATENT DOCUMENTS

| | | | | |
|---|---|---|---|---|
| 460,350 | A * | 9/1891 | Cole | 4/255.02 |
| 3,608,098 | A | 9/1971 | Andrisani | |
| 3,823,427 | A * | 7/1974 | Pittet | 4/255.01 |
| 6,205,594 | B1 | 3/2001 | Solaberry | |
| 6,907,622 | B2 | 6/2005 | Rasaei et al. | |
| 7,877,821 | B1 | 2/2011 | Prestia | |
| 8,418,275 | B1 * | 4/2013 | Dondurur et al. | 4/255.04 |
| 2003/0028957 | A1 | 2/2003 | Kawai | |
| 2005/0050624 | A1 | 3/2005 | Pangramuyen | |
| 2007/0266485 | A1 | 11/2007 | Tackett | |
| 2008/0244819 | A1 | 10/2008 | Meador | |
| 2008/0276359 | A1 * | 11/2008 | Morgan et al. | 4/255.04 |
| 2014/0026307 | A1 * | 1/2014 | Washington, Jr. | 4/255.01 |

FOREIGN PATENT DOCUMENTS

| | | |
|---|---|---|
| WO | WO 93/14273 A1 | 7/1993 |

* cited by examiner

*Primary Examiner* — Huyen Le
*Assistant Examiner* — Erin Deery
(74) *Attorney, Agent, or Firm* — Richard C. Litman

(57) ABSTRACT

The system for unclogging toilets is a wire-based unclogging system for toilets, allowing clogs formed on either side of a bend in a toilet outflow pipe to be cleared simultaneously. The system includes a hollow tube having opposed upper and lower ends. The tube is mounted on a toilet so that a pair of apertures formed through the lower end communicate with an interior of the bend of the toilet outflow pipe. A plunger is slidably mounted within an interior of the tube and is resiliently biased with respect to the upper end. An air pump delivers pressurized air to the interior of the tube through a port formed through the upper end, so that the plunger may be driven downward. A pair of wires are secured to a lower surface of the plunger and extend through the apertures into either side of the bend of the toilet outflow pipe.

16 Claims, 3 Drawing Sheets

SYSTEM FOR UNCLOGGING TOILETS

BACKGROUND OF THE INVENTION

1. Field of the Invention

The present invention relates to plumbing, and particularly to a system for unclogging toilets utilizing pressurized air to deploy unclogging wires within a toilet pipe.

2. Description of the Related Art

Clogs formed in the pipes of toilets are very common. Toilet plungers are the most common tool for clearing toilet clogs. Although plungers are useful tools in unclogging most toilets, they are not sanitary instruments. In use, contaminated water may easily be sprayed or spilled during the unclogging process, along with the contaminated water dripping off of the plunger following use thereof. Additionally, plungers may be used for most clogs, but are not effective for all clogs. For more serious clogs, harsh chemicals or plumbing snakes or drain augers are typically used. The common household user, however, tends to avoid the use of harmful and toxic chemicals when possible, and plumbing snakes are typically only employed by professional plumbers. It would be desirable to provide the effectiveness of the plumbing snake in a convenient system, readily adaptable to a common household toilet.

Thus, a system for unclogging toilets solving the aforementioned problems is desired.

SUMMARY OF THE INVENTION

The system for unclogging toilets is a wire- or snake-based unclogging system for toilets, allowing clogs formed on either side of a bend in a toilet outflow pipe to be cleared simultaneously. The system includes a hollow tube having opposed closed upper and lower ends. The upper end has a port formed therethrough and the lower end has a pair of apertures formed therethrough. The hollow tube is mounted on a toilet so that the pair of apertures are in communication with an interior of the bend of the toilet outflow pipe.

A plunger is slidably mounted within an interior of the hollow tube. The plunger forms a fluid-tight seal with an interior wall of the hollow tube. The plunger is resiliently biased with respect to the upper end of the hollow tube. An air pump selectively delivers pressurized air to the interior of the hollow tube through the port formed through the upper end of the hollow tube, so that the plunger may be selectively driven downward within the hollow tube. A pair of wires are further provided, each having opposed fixed and free ends. The fixed ends thereof are secured to a lower surface of the plunger. The pair of wires extend through the pair of apertures so that the free ends thereof may break up clogs formed on either side of the bend of the toilet outflow pipe when the pressurized air is delivered to the interior of the hollow tube.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
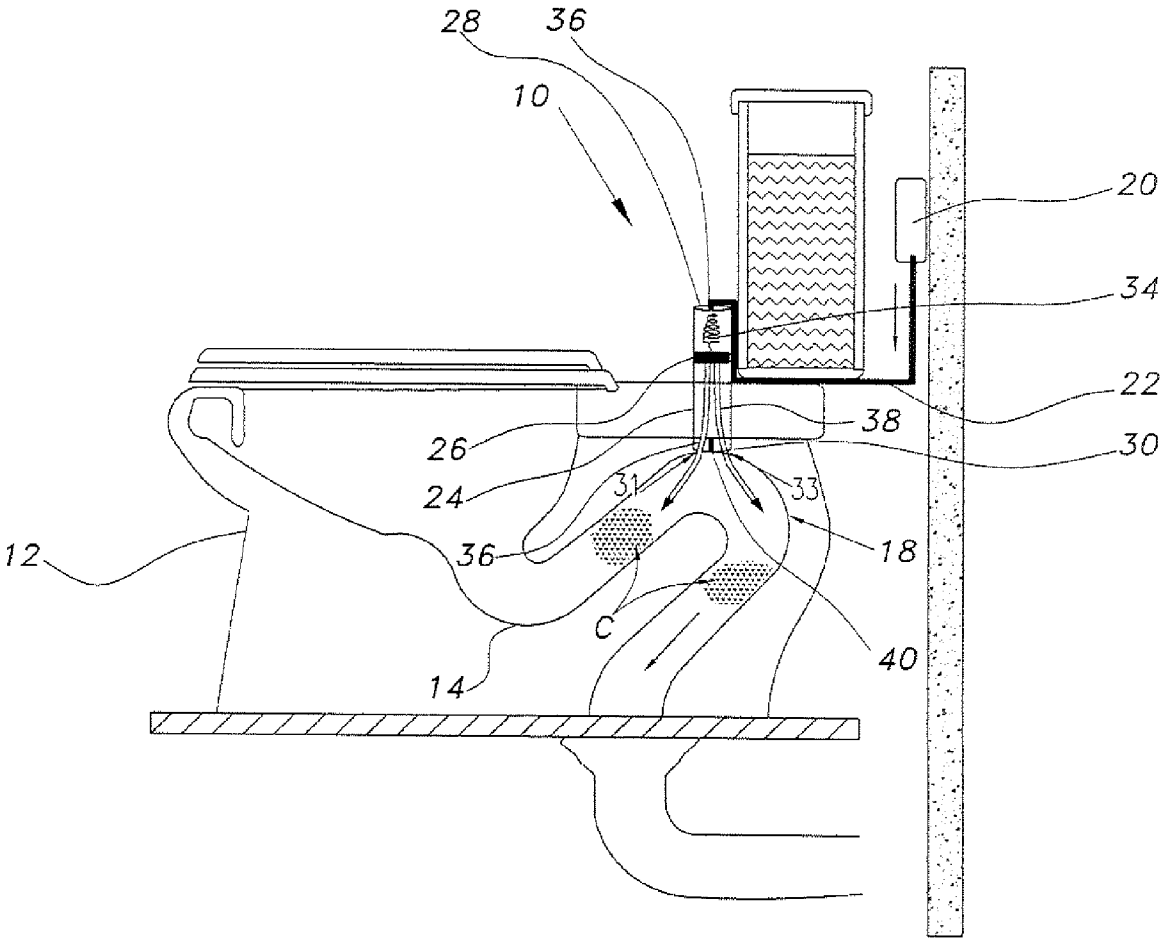
FIG. 1 is a schematic environmental side view in section illustrating a system for unclogging toilets according to the present invention.

The system for unclogging toilets 10 is a wire or snake-based unclogging system for toilets, allowing clogs C formed on either side of a bend 18 in a toilet outflow pipe 14 to be cleared simultaneously. As shown in FIG. 1, the system 10 includes a hollow tube 24 having opposed closed upper and lower ends 28, 30, respectively. The upper end 28 has a port 32 formed therethrough, and the lower end 30 has a pair of apertures 31, 33 formed therethrough. The hollow tube 24 is mounted on a toilet 12 so that the pair of apertures 31, 33 are in communication with an interior of the bend 18 of the toilet outflow pipe 14. The hollow tube 24 may be formed from any suitable material with the structural strength to allow for the input of pressurized air, as will be described in detail below.

A plunger 26 is slidably mounted within an interior of the hollow tube 24. The plunger 26 forms a fluid-tight seal with an interior wall of the hollow tube 24. The plunger is resiliently biased with respect to the upper end 28 of the hollow tube 24 by a helical spring 34 or the like. Preferably, as shown, the hollow tube 24 is substantially cylindrical, and the plunger 26 preferably has a circular perimeter for forming the fluid-tight seal with the interior wall.

An air pump 20 selectively delivers pressurized air to the interior of the hollow tube 24 through the port 32 formed through the upper end 28 of hollow tube 24, so that the plunger 26 may be selectively driven downward within the hollow tube 24. It should be understood that any suitable type of air pump 20 or other source of pressurized air may be utilized. The air pump 20 is shown as being mounted on a wall behind the tank of the toilet 12 and delivering air through line 22. It should be understood that the air pump 20 may be positioned in any other suitable location adjacent the toilet 12.

Figure 2:
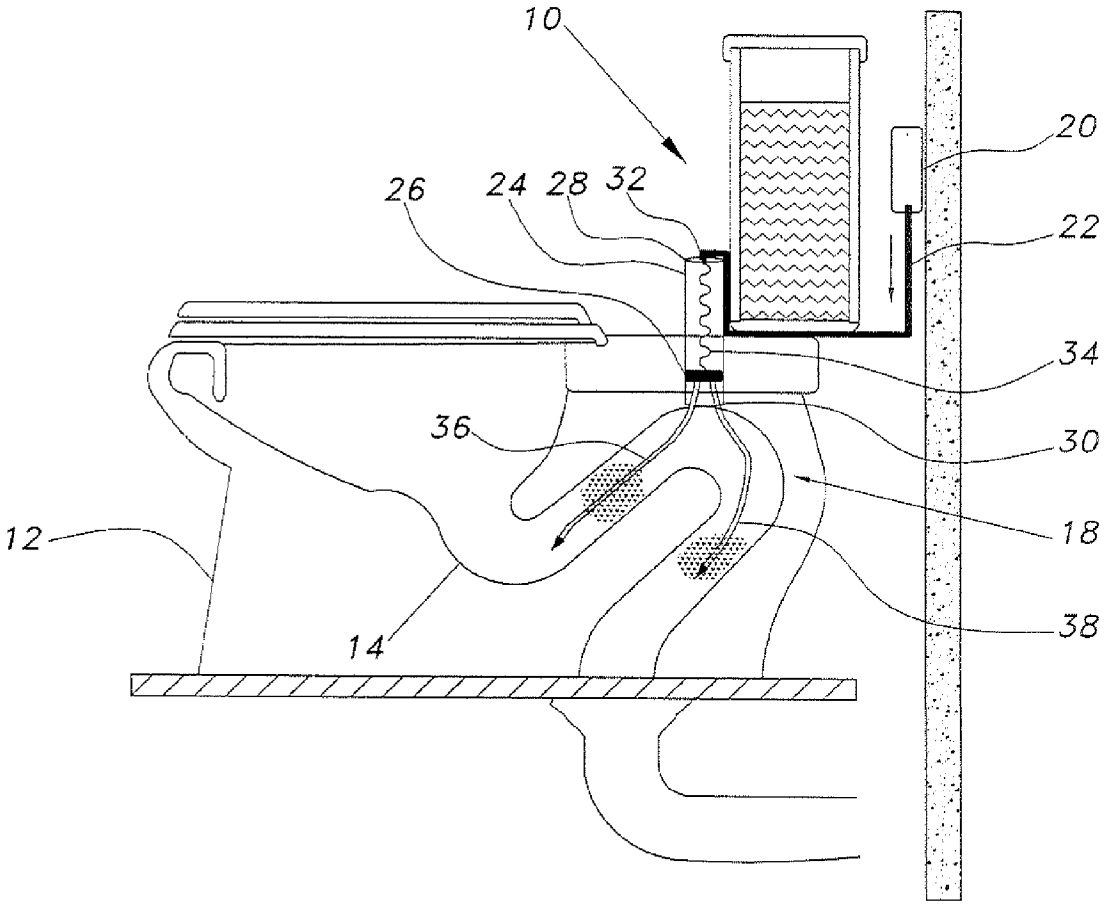
FIG. 2 is a schematic environmental side view in section of the system for unclogging toilets of FIG. 1, showing a pair of wires for unclogging the toilet being deployed.

A pair of wires 36, 38 are further provided, each having opposed fixed and free ends. The fixed ends thereof are secured to a lower surface of the plunger 26. The pair of wires 36, 38 extend through the pair of apertures 31, 33, respectively formed by partition 40, so that the free ends thereof may break up clogs C formed on either side of the bend 18 of the toilet outflow pipe 14 when the pressurized air is delivered to the interior of the hollow tube 24. As shown in FIG. 2, the pressurized air drives the plunger 26 downward, thus driving wires 36, 38 downward. When clogs C are removed, air is released from within the tube 24, and the spring 34 lifts the plunger 26 within the tube 24, thus retracting the wires 36, 38. In order to release the pressurized air, the air pump 20 may be actuated in reverse to create suction, or the pressurized air may be released through a release valve formed in the hollow tube 24. The wires 36, 38 may be any suitable type of wires or plunging snakes, as are known in the field of plumbing for removing clogs in toilet pipes.

Figure 3:
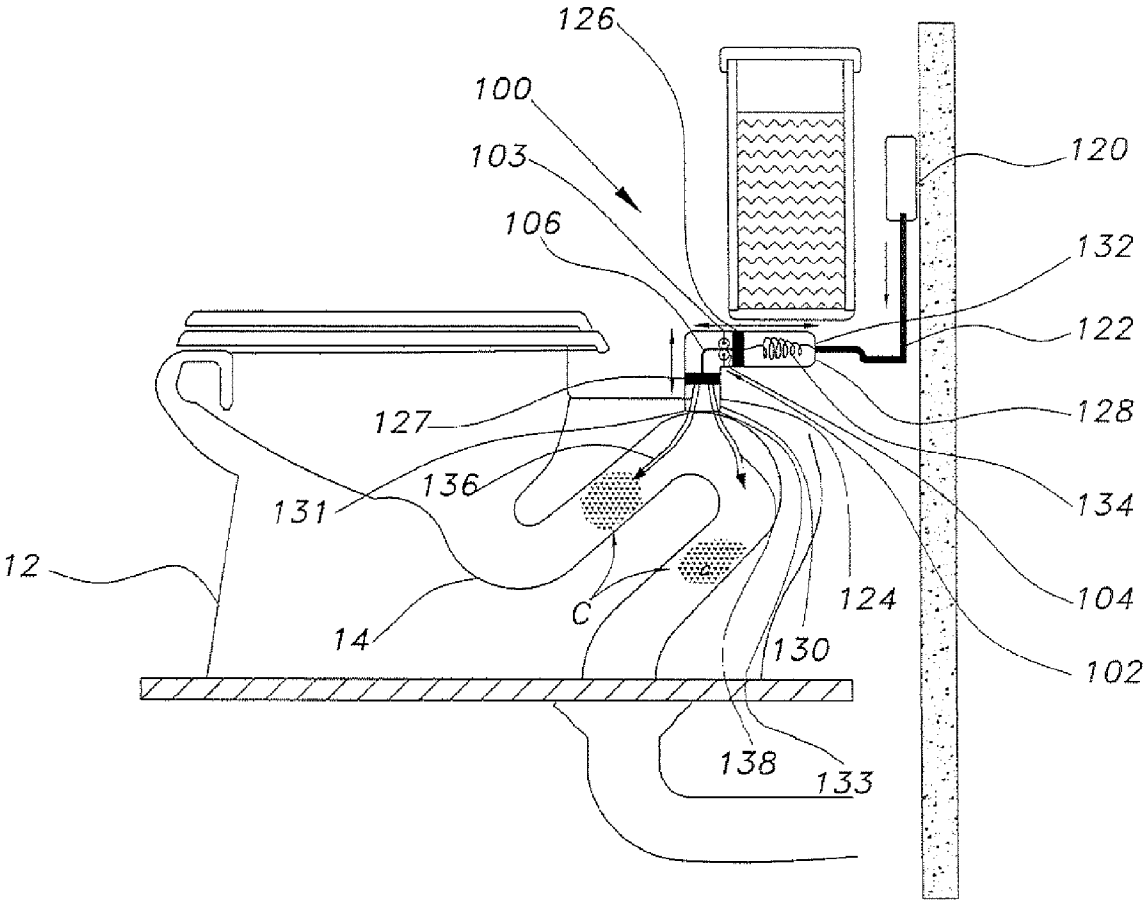
FIG. 3 is a schematic environmental side view in section of an alternative embodiment of a system for unclogging toilets according to the present invention.

In an alternative embodiment, the system 100 of FIG. 3 includes a substantially L-shaped hollow tube 124 having opposed first and second ends 128, 130, respectively. As in the previous embodiment, the first and second ends 128, 130 are both closed, and the first end 128 has a port 132 formed therethrough, while the second end 130 has a pair of apertures 131, 133 formed therethrough. The L-shaped hollow tube 124 is adapted for mounting on the toilet 12 so that the pair of apertures 131, 133 are in communication with an interior of a bend 18 of a toilet outflow pipe 14.

First and second plungers 126, 127, respectively, are slidably mounted within an interior of the L-shaped hollow tube 124. The first plunger 126 is positioned adjacent the first end 128, and second plunger 127 is positioned adjacent the second end 130. As in the previous embodiment, each segment of the L-shaped hollow tube 124 is preferably substantially cylindrical, and each of first and second plungers 126, 127 has a substantially circular perimeter, forming a fluid-tight seal with an interior wall of the hollow tube 124.

As in the previous embodiment, the first plunger 126 is resiliently biased with respect to the first end 128 of the hollow tube 124 by a helical spring 134 or the like. A guide wire 106 is secured at either end to (and extends between) the first and second plungers 126, 127, respectively. The guide wire 106 may be any suitable type of wire having sufficient tensile strength to push the second plunger 127 downward within the hollow tube 124, as will be described below.

Pressurized air is selectively delivered to the interior of the hollow tube through the port 132 formed through the first end 128 of the hollow tube 124 so that the first plunger 126 may be selectively driven within the hollow tube 124. As in the previous embodiment, pressurized air may be delivered by an air pump 120 through a line 122 to the port 132, or may be delivered by any other suitable delivery system for pressurized air. The air pump 120 may be wall-mounted, as shown, or may be positioned in any other suitable location adjacent the toilet 12. The guide wire 106 is fixed to the first plunger 126, driving the second plunger 127 downward within the hollow tube toward the second end 130 upon delivery of the pressurized air.

A stopper member 102 is preferably positioned within the interior of the hollow tube 124 adjacent the first plunger 126, preventing movement of first plunger 126 beyond a pre-selected point. A central opening 104 is formed through the stopper member 102 for receiving the guide wire 106, as shown. One or more rollers 103 may be mounted on the stopper member 102 adjacent the opening 104 for supporting and guiding the guide wire 106.

A pair of wires 136, 138, similar to wires 36, 38 of the previous embodiment, are provided. Each wire has opposed fixed and free ends. The fixed ends thereof are secured to a lower surface of the second plunger 127. The pair of wires extend through the pair of apertures 131, 133, respectively, so that the free ends of wires 136, 138 may break up clogs C formed on either side of the bend 18 of the toilet outflow pipe 14 when the pressurized air is delivered to the interior of the hollow tube 124. Following the unclogging of the pipe 14, the wires 136, 138 are retracted through release of the pressurized air within the hollow tube 124. In order to release the pressurized air therein, the air pump 120 may be actuated in reverse to create suction, or the pressurized air may be released through a release valve formed in hollow tube 124.

It is to be understood that the present invention is not limited to the embodiments described above, but encompasses any and all embodiments within the scope of the following claims.

We claim:

1. A system for unclogging toilets, comprising:

a hollow tube having opposed upper and lower ends, the upper and lower ends being closed, the upper end having a port formed therethrough, the lower end having a pair of apertures formed therethrough, the hollow tube being adapted for mounting on a toilet so that the pair of apertures are in communication with an interior of a bend of a toilet outflow pipe;

a plunger slidably mounted within the hollow tube, the plunger forming a fluid-tight seal with an interior wall of the hollow tube;

means for resiliently biasing the plunger with respect to the upper end of the hollow tube;

means for delivering pressurized air to the interior of the hollow tube through the port formed through the upper end of the hollow tube so that the plunger may be selectively driven downward within the hollow tube; and a pair of wires, each of the wires having opposed fixed and free ends, the fixed ends being secured to a lower surface of the plunger, the pair of wires extending through the pair of apertures so that the free ends thereof may break up clogs formed on either side of the bend of the toilet outflow pipe when the pressurized air is delivered to the interior of the hollow tube.

2. The system for unclogging toilets as recited in claim 1, wherein said means for delivering the pressurized air to the interior of said hollow tube comprises an air pump.

3. The system for unclogging toilets as recited in claim 1, wherein said means for resiliently biasing said plunger with respect to the upper end of said hollow tube comprises a spring secured at either end to the upper end of said hollow tube and an upper surface of said plunger.

4. The system for unclogging toilets as recited in claim 1, wherein said hollow tube is substantially cylindrical.

5. The system for unclogging toilets as recited in claim 1, wherein:

the plunger further includes an additional plunger slidably mounted within an interior of the hollow tube, the plunger and additional plunger each forming a fluid-tight seal with an interior wall of the hollow tube;

a guide wire secured at either end to the plunger and additional plunger for driving the additional plunger downward within the hollow tube; and wherein the fixed ends of the pair of wires being secured to a lower surface of the additional plunger.

6. The system for unclogging toilets as recited in claim 5, wherein said means for delivering the pressurized air to the interior of said hollow tube comprises an air pump.

7. The system for unclogging toilets as recited in claim 6, wherein said means for resiliently biasing said plunger with respect to the upper end of said hollow tube comprises a spring secured at either end to the upper end of said hollow tube and an upper surface of the plunger.

8. The system for unclogging toilets as recited in claim 1, wherein said hollow tube is substantially L-shaped.

9. The system for unclogging toilets as recited in claim 5, further comprising a stopper mounted within the interior of said hollow tube between said plunger and additional plunger, the stopper having a central opening formed therethrough, said guide wire extending through the central opening.

10. The system for unclogging toilets as recited in claim 9, further comprising at least one roller mounted on said stopper adjacent the central opening formed therethrough for supporting and guiding said guide wire.

11. A system for unclogging toilets, comprising:

a hollow tube having opposed upper and lower ends, the upper and lower ends being closed, the upper end having a port formed therethrough, the lower end having at least one aperture formed therethrough, the hollow tube being adapted for mounting on a toilet so that at least one aperture is in communication with an interior of a toilet outflow pipe;

a plunger slidably mounted within an interior of the hollow tube, the plunger forming a fluid-tight seal with an interior wall of the hollow tube;

means for resiliently biasing the plunger with respect to the upper end of the hollow tube;

means for delivering pressurized air to the interior of the hollow tube through the port formed through the upper end of the hollow tube so that the plunger may be selectively driven downward within the hollow tube; and at least one wire having opposed fixed and free ends, the fixed end being secured to a lower surface of the plunger, the at least one wire extending through the at least one aperture so that the free end may break up clogs formed within the toilet outflow pipe when the pressurized air is delivered to the interior of the hollow tube.

12. The system for unclogging toilets as recited in claim 11, wherein said means for delivering the pressurized air to the interior of said hollow tube comprises an air pump.

13. The system for unclogging toilets as recited in claim 11, wherein said means for resiliently biasing said plunger with respect to the upper end of said hollow tube comprises a spring secured at either end to the upper end of said hollow tube and an upper surface of said plunger.

14. The system for unclogging toilets as recited in claim 11, wherein said hollow tube is a substantially cylindrical.

15. The system for unclogging toilets are recited in claim 14, wherein the at least one wire comprises a pair of wires.

16. The system for unclogging toilets as recited in claim 15, wherein the at least one aperture comprises a pair of apertures.

* * * * *